United States Patent [19]

Torii

[11] 3,999,791

[45] Dec. 28, 1976

[54] DOOR LATCH DEVICE

[75] Inventor: Nozomu Torii, Hekinan, Japan

[73] Assignee: Aisin Seiki Kabushiki Kaisha, Japan

[22] Filed: Apr. 16, 1975

[21] Appl. No.: 568,739

[30] Foreign Application Priority Data

Apr. 19, 1974 Japan ..... 49-44815

[52] U.S. Cl. ..... 292/216; 292/280

[51] Int. Cl.[2] ..... E05C 3/06; E05C 19/00

[58] Field of Search ..... 292/216, 280, DIG. 26, 292/DIG. 27

[56] References Cited

UNITED STATES PATENTS

| | | | |
|---|---|---|---|
| 3,365,226 | 1/1968 | Shay | 292/DIG. 27 |
| 3,511,526 | 5/1970 | Ploughman | 292/216 |
| 3,572,792 | 3/1971 | Foley | 292/216 |
| 3,672,713 | 6/1972 | Pickles | 292/DIG. 27 |
| 3,695,660 | 10/1972 | Fetters | 292/DIG. 27 |
| 3,797,243 | 10/1973 | Yoshimura | 292/DIG. 26 |
| 3,804,441 | 4/1974 | Kobayashi et al. | 292/DIG. 26 |
| 3,823,966 | 7/1974 | Torii | 292/DIG. 26 |

*Primary Examiner*—Paul R. Gilliam
*Assistant Examiner*—C. F. Pietruszka
*Attorney, Agent, or Firm*—Oblon, Fisher, Spivak, McClelland & Maier

[57] ABSTRACT

A door latch device includes a cancel lever pivoted to an intermediate lever in its initial position to be engaged with a pawl lever upon engagement of a pawl and latch mechanism so as to move the intermediate lever from the locked position to the unlocked position, a stopper element to rotate the cancel lever by engagement therewith upon sliding movement of the intermediate lever relative to the locking lever caused by operating the release lever when the door is open and the locking lever is in its locked position so as to disable engagement of the cancel lever with the pawl lever, and a snap action spring interconnected between the cancel lever and the intermediate lever for holding the cancel lever in either the initial position upon engagement of the pawl and latch mechanism or the rotated position thereof after engagement of the cancel lever with the stopper.

3 Claims, 6 Drawing Figures

DOOR LATCH DEVICE

BACKGROUND OF THE INVENTION

The present invention relates to a door latch device and more particularly to an improvement of a door latch device including a keyless locking mechanism and a self-cancelling mechanism.

In a conventional vehicle door latch device of this kind, the keyless locking mechanism is provided to facilitate locking of a vehicle door particularly in the rain or when the operator can not use both of his hands to close and lock the door, and the self-cancelling mechanism is provided to cancel the operative condition of the keyless locking mechanism so as to prevent any inadvertent locking of the door while the ignition key remains in the vehicle. However, in order to ensure the function of the keyless locking mechanism when the door is closed, an outside door handle has to be forcibly held after the keyless locking mechanism is set in its operative condition for automatic locking. This is inconvenient when the operator is unable to use either of his hands, for example, when it rains.

SUMMARY OF THE INVENTION

The primary object of the present invention is to provide an improved door latch device including the keyless locking mechanism and the self-cancelling mechanism, wherein the keyless locking mechanism can be maintained operative and the self-cancelling mechanism is held inoperative by temporarily operating either the inside or outside door handle under the most convenient condition of the operator after the keyless locking mechanism is once set up in its operative condition.

Another object of the present invention is to provide an improved door latch device, having the above-mentioned characteristics, wherein the self-cancelling mechanism performs its function when the door is closed without temporarily operating either of the inside or outside door handle after the keyless locking mechanism is set in its operative condition.

BRIEF DESCRIPTION OF THE DRAWINGS

Additional objects and advantages of the present invention will be more readily apparent from the following detailed description of preferred embodiment thereof when taken together with the accompanying drawings in which.

DESCRIPTION OF THE PREFERRED EMBODIMENT

Figure 1:
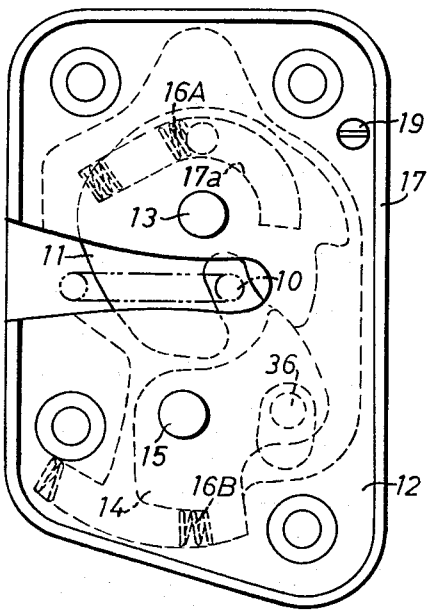
FIG. 1 is a front view of a vehicle door latch device in accordance with the present invention, showing a pawl and latch mechanism.

Referring now to the drawings, FIG. 1 illustrates a latch and pawl mechanism assembled with the front side of a vehicle door latch device in accordance with the present invention. In FIG. 1, a latch element 11 is housed within a hollowed portion of a synthetic resin block 17 and pivoted at 13 to a main frame of plate 18 which is adapted to be mounted on the inside of the lock pillar wall of a vehicle door by suitable bolts extending through threaded embossments. The latch element 11 is also biased in the clockwise direction by a coil spring 16A which is interposed between a portion of the latch element 11 and the left end of an arcuate groove **17*a* provided on the resin block 17. The resin block 17 is concealed by a cover plate 12 and integrally secured on the front side of the main plate 18 together with the cover plate 12 by a fastening screw 19. A pawl element 14 is pivoted at 15 to the main plate 18 within the hollowed portion of the resin block 17 and is biased in the counterclockwise direction by a coil spring 16B which is interposed between shoulders of the resin block 17 and the pawl element 14. With this latch and pawl mechanism, when the latch element 11 is in its latched position, as shown in FIG. 1, the pawl element 14 engages the latch element 11 and a striker pin 10 is trapped between the throat of the latch element 11 and the pawl element 14. The striker pin 10 is mounted on the lock pillar wall of the vehicle body and the engagement of the latch element 11 in the latched position with the striker pin 10** maintains the vehicle door in the closed position.

Figure 2:
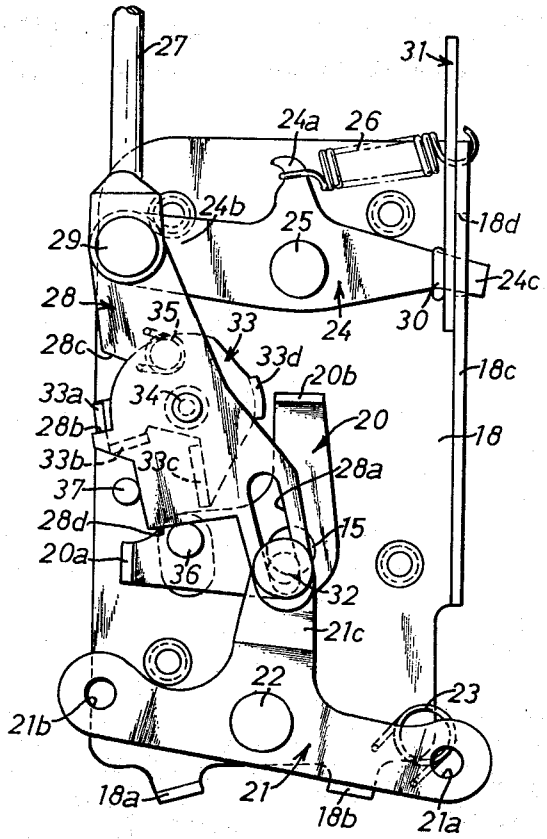
FIG. 2 is a backside view of the vehicle door latch device of FIG. 1, showing a keyless locking mechanism and a self-cancelling mechanism in locked position.

FIG. 2 illustrates a locking mechanism assembled with the back side of the main plate 18 wherein the pivot 15 of the pawl element 14 projects outwardly at one end thereof. A pawl lever 20, located at the lower portion of the main plate 18, is fixed on the projected end of the pivot 15 and is integrally connected at its left arm to the pawl element 14 by a pin 36 which extends through an opening provided on the main plate 18. A locking lever 21, located at the lower end of the main plate 18, is pivoted at 22 to the main plate 18 and is provided at its right end with a connecting hole **21*a* to be operatively connected with a conventional garnish button and at its left end with a connecting hole 21*b* to be interlocked with an outside key cylinder arrangement. An over-center-type coil torsion spring 23 is interconnected between the locking lever 21 and the main plate 18 to thereby hold the locking lever 21 in either a locked position, shown in FIG. 2, wherein the bottom edge of the locking lever 21 engages a lateral tab 18*b* of the main plate 18 or an unlocked position, shown in FIG. 4, wherein the bottom edge of the locking lever 21 engages a lateral tab 18*a* of the main plate 18**.

Figure 3:
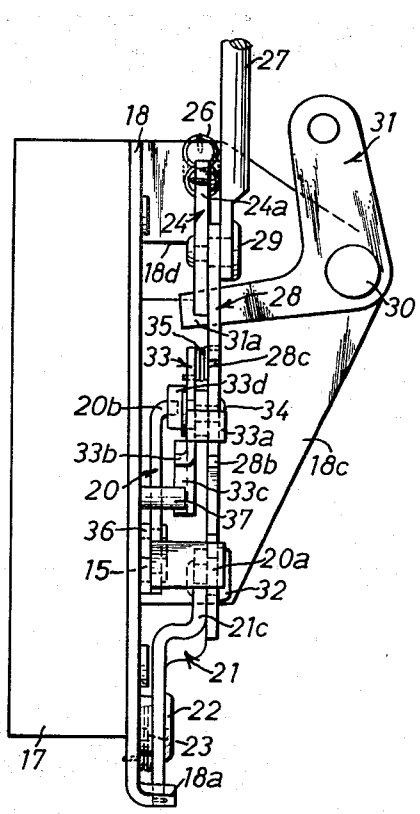
FIG. 3 is a side view of the door latch device of FIG. 1.

A release lever 24, located at the upper portion of the main plate 18, is pivoted at 25 to the main plate 18 and is biased in the clockwise direction by a coil spring 26 which is stretched between a portion of a lateral flange **18*c* of the main plate 18 and a notched arm 24*a* of the release lever 24. The left arm 24*b* of the release lever 24 is rotatably connected by a pivot pin 29 with an intermediate lever 28 and a push rod 27 to be connected with an outside handle for release of the pawl element 14 from the outside of the vehicle. The right arm 24*c* of the release lever 24 extends through an opening 18*d* provided on the lateral flange 18*c* to be engageable with the free end 31***a* of an inside open lever 31, as shown in FIG. 3. The inside open lever 31 is pivoted at 30 to the left side of the lateral flange 18*c*, in the figure, and is connected with an inside handle for release of the pawl element 14 from the inside of the vehicle. When the inside open lever 31 is rotated in the clockwise direction around the pivot 30 by the inside handle in FIG. 3, the release lever 24 is moved in the counterclockwise direction around the pivot 25 against the biasing force of the coil spring 26 so as to shift the intermediate lever 28 downwardly in FIG. 2. The intermediate lever 28 is provided at the free end portion thereof with an elongated sliding slot 28*a* which is slidably coupled with a pin 32 fixed on an upwardly extending arm 21*c* of the locking lever 21. The intermediate lever 28 further includes a shoulder 28*d* to be engageable with a laterally outwardly extending tab 20*a* of the pawl lever 20 when the locking lever 21 is in its unlocked position and the intermediate lever 28 is rotated in the clockwise direction, as shown in FIG. 4.

A cancel lever 33, located under the intermediate lever 28, is pivoted at 34 to the substantially central portion of the lever 28 and has a laterally outwardly extending tab 33*a* to be selectively engaged with shoulders 28*b* and 28*c* of the intermediate lever 28. Between the cancel lever 33 and the intermediate lever 28 there is interconnected therewith an over-center-type coil torsion spring 35 which serves to engage the tab 33*a* of the cancel lever 33 with either shoulder 28*b* or 28*c* of the intermediate lever 28. The cancel lever 33 is also provided with a laterally inwardly extending tab 33*d* engageable with a laterally outwardly extending tab 20*b* of the pawl lever 20 and other laterally inwardly extending tabs 33*b* and 33*c* engageable with a stopper pin 37 fixed on the main plate 18. The pin 37 underlies the intermediate lever 28 when the lever 28 is rotated in the clockwise direction, as shown in FIG. 4.

Assuming that the door is closed and the locking lever 21 is in its locked position, as shown in FIG. 2, the shoulder 28*d* of the intermediate lever 28 will not engage the lateral tab 20*a* of the pawl lever 20 when the intermediate lever 28 shifts downwardly. In this locked condition, even if the operator rotates the release lever 24 in the counterclockwise direction by operating either the inside open lever 31 or the push rod 27, the intermediate lever 28 is merely shifted downwardly due to the relative movement between the pin 32 of the locking lever 21 and the slot 28*a* of the lever 28 so that the pawl lever 20 will remain in its latched position.

Figure 4:
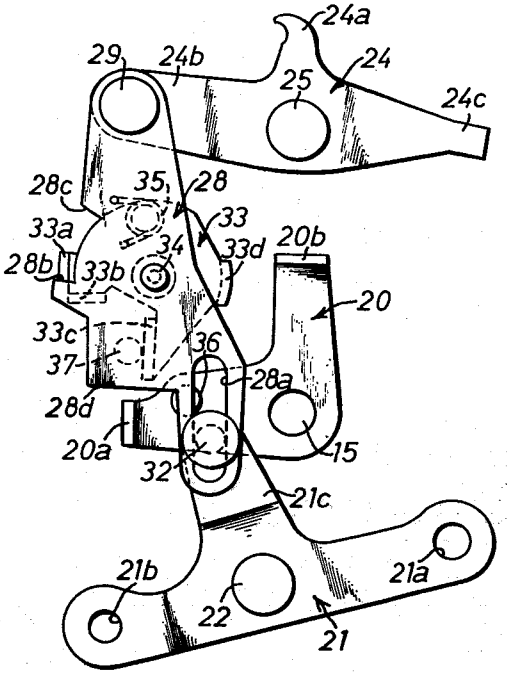
FIG. 4 depicts the keyless locking mechanism and the self-cancelling mechanism when the door latch device is in its unlocked position.

If the operator moves the locking lever 21 from the locked position of FIG. 2 to the unlocked position of FIG. 4 by raising the garnish button or operating the key cylinder assembly, the intermediate lever 28 is rotated in the clockwise direction around the pivot pin 29 by the pin 32 of the locking lever 21 through the elongated slot 28*a* of the lever 28 so that the shoulder 28*d* of the intermediate lever 28 will engage the lateral tab 20*a* of the pawl lever 20 when the intermediate lever 28 shifts downwardly. In this unlocked condition, if the operator rotates the release lever 24 in the counterclockwise direction by operating either the inside open lever 31 or the push rod 27, the intermediate lever 28 is shifted downwardly due to the relative movement between the pin 32 of the locking lever 21 and the elongated slot 28*a* of the lever 28 and, in turn, the pawl lever 20 is rotated in the counterclockwise direction around the pivot 15 by engagement of the shoulder 28*d* of the intermediate lever 28 to the lateral tab 20*a*. This releases the engagement of the pawl element 14 with the latch element 11 thereby to permit opening of the door.

If the operator moves the locking lever 21 from the unlocked position of FIG. 4 to the locked position of FIG. 2 by depressing the garnish button or operating the key cylinder assembly before he closes the door and thereafter closes the door, the pawl lever 20 is moved in the counterclockwise direction around the pivot 15 as a result of the arcuate movement of the pawl element 14 caused by rotation of the latch element 11 and, in turn, the cancel lever 33 is moved leftwardly upon engagement of the lateral tab 20*b* of the pawl lever 20 with the lateral tab 33*d* of the cancel lever 33. This swings the intermediate lever 28 in the clockwise direction so as to return the locking lever 21 to the unlocked position of FIG. 4 by means of the movement between the pin 32 of the locking lever 21 and the elongated slot 28*a* of the intermediate lever 28 so that the locked position of the locking lever 21 is instantly cancelled. Thus, the door can be opened by operating either the inside or outside door handle.

Figure 6:
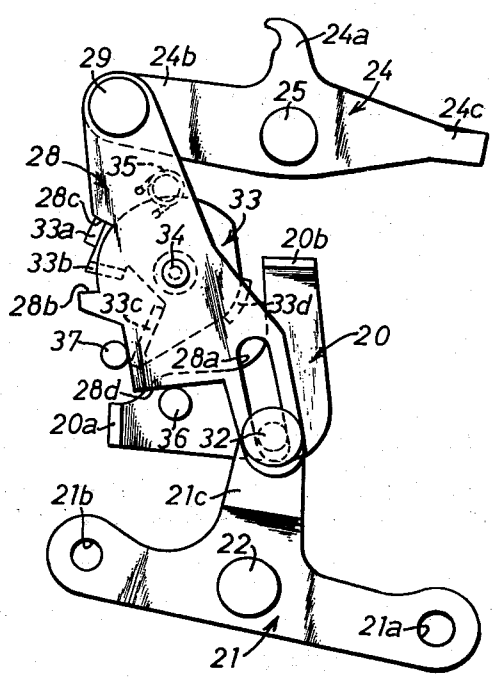
FIGS. 5 and 6 depict the keyless locking mechanism to be maintained in its operative condition by temporarily operating either the inside or outside handle after the keyless locking mechanism is once set up in its operative condition.
Figure 5:
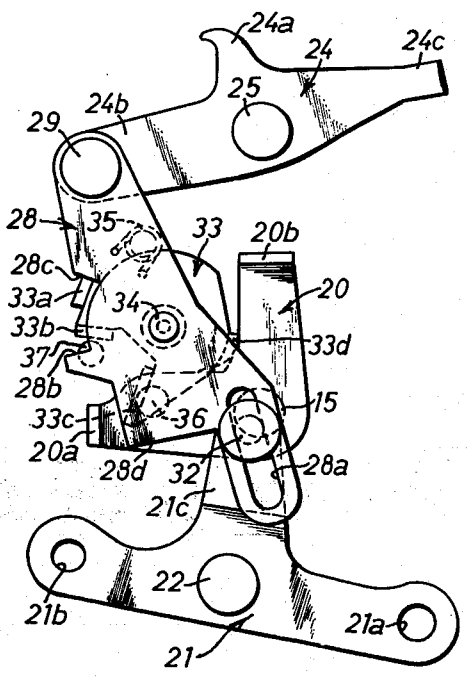

To keylessly lock the door, the operator opens the door and depresses the garnish button to move the locking lever 21 to the locked position of FIG. 2. In this condition, when the release lever 24 is rotated in the counterclockwise direction around the pivot 25 by operating either the inside or outside door handle, the downward movement of the intermediate lever 28 engages the lateral tab 33*b* of the cancel lever 33 to the stopper pin 37 of the main plate 18 to rotate the cancel lever 33 in the clockwise direction, as shown in FIG. 5. After the operation of the inside or outside door handle is released, the cancel lever 33 will remain in its rotated position by snap action of the torsion coil spring 35, as shown in FIG. 6, and when the pawl lever 20 swings in the counterclockwise direction the lateral tab 20*b* of the pawl lever 20 will not engage the lateral tab 33*d* of the cancel lever 33. As a result, when the door is closed by the operator and the pawl lever 20 is rotated in the counterclockwise direction in response to engaging movement of the pawl and latch mechanism, the intermediate lever 28 and the locking lever 21 remain in the locked position of FIG. 6 so that the door is keylessly locked by the locking mechanism without any further performance.

The above described keyless locking can be summarized in the following steps;

depressing the garnish button with the door kept open, operating temporarily either of the inside or outside door handle, and closing the door to lock it automatically.

Thus, it should be well recognized that the door can be closed and locked by hand or any portion of the human body without using the inside or outside door handle.

If the operator wishes to open the keylessly locked door, the operator moves the locking lever 21 to the unlocked position of FIG. 4 by operating the key cylinder assembly or raising the garnish button. In this instance, the cancel lever 33 engaged at the lateral tab 33*c* thereof with the stopper pin 37 is rotated in the counterclockwise direction around the pivot 34 as the intermediate lever 28 is swung in the clockwise direction around the pivot pin 29 by the movement of the locking lever 21. Thus, the intermediate lever 28 and the cancel lever 33 return to their unlocked position of FIG. 4 so that the door can be opened by operating the inside or outside door handle.

Having thus described the preferred embodiment of the invention it should be understood that numerous structural modifications and adaptations may be resorted to without departing from the spirit of the invention.

What is claimed is:

1. In a door latch device comprising:

a main plate secured on the side edge of a door;

a latch element pivoted on the front side of said main plate and movable between latched and unlatched positions;

a pawl element pivoted on the front side of said main plate and movable between engaged and disengaged positions with respect to said latch element so as to selectively hold or release a striker element secured on a lock pillar;

a pawl lever integrally assembled with said pawl element at the back side of said main plate so as to be moved in response to the movement of said pawl element;

a release lever pivoted on the back side of said main plate and operatively interlocked respectively at both ends thereof with an inside door handle and an outside door handle;

a locking lever pivoted on the back side of said main plate and movable between locked and unlocked positions by means of a key cylinder assembly or an inside locking means operatively connected therewith;

an intermediate lever pivoted at one end thereof to said release lever and coupled at its other end with said locking lever and including means for providing a sliding and pivotal movement relative to said locking lever, said intermediate lever being pivoted by means of said locking lever between locked and unlocked positions and being movable, by means of the pivotable movement of said release lever, with respect to said locking lever, and including shoulder means engageable with said pawl lever for causing disengagement of said pawl and latch elements when said locking lever is in its unlocked position;

cancel lever means pivoted upon said intermediate lever between locked and unlocked positions and including shoulder means for engaging said pawl lever in its unlocked position so as to move said intermediate lever from a locked position thereof to an unlocked position thereof;

stopper means provided on the back side of said main plate for rotating said cancel lever from the unlocked position to the locked position by engagement of said cancel lever and said stopper means when said intermediate lever is shifted while said locking lever is in its locked position and for returning said cancel lever from said locked position to said unlocked position by engagement of said cancel lever and said stopper means when said intermediate lever is moved from the locked position to the unlocked position by said locking lever; and an over-center-type torsion spring interconnected between said cancel lever and said intermediate lever for holding said cancel lever in either the locked position or the unlocked position, whereby when the door is closed with said locking lever held in the locked position, said intermediate lever is moved from the locked position to the unlocked position by engagement of said pawl lever with the shoulder of said cancel lever so as to return said locking lever to the unlocked position, and when the door is closed with said locking lever held in the locked position after said intermediate lever is shifted by said release lever to move said cancel lever to the locked position, said intermediate lever and said locking lever will remain in the locked position so as to keylessly lock the door.

2. A door latch device as claimed in claim 1, wherein:

said cancel lever is provided with a first lateral tab to be selectively engaged with a pair of shoulders provided on said intermediate lever so as to move said cancel lever to either said locked position or said unlocked position, a second lateral tab engageable with a lateral tab provided on said pawl lever, and a pair of shoulders to be selectively engaged with said stopper means as a result of said movement of said intermediate lever relative to said locking lever.

3. A door latch device as claimed in claim 2, wherein said stopper means is a stopper pin fixed on the back side of said main plate and said pair of shoulders of said cancel lever are a pair of lateral tabs provided on said cancel lever.

* * * * *